United States Patent [19]

Strunc

[11] 4,225,073

[45] Sep. 30, 1980

[54] MULTIPLE SPEED WEB DRIVE SYSTEM

[75] Inventor: Gerald R. Strunc, Maple Grove, Minn.

[73] Assignee: Pako Corporation, Minneapolis, Minn.

[21] Appl. No.: 791,703

[22] Filed: Apr. 28, 1977

[51] Int. Cl.[3] ..... B65H 17/26

[52] U.S. Cl. ..... 226/49; 226/136; 226/141

[58] Field of Search ..... 226/136, 139, 141, 178, 226/29, 30, 134, 90, 199, 49

[56] References Cited

U.S. PATENT DOCUMENTS

| | | | |
|---|---|---|---|
| 3,362,601 | 1/1968 | Ford | 226/141 |
| 3,656,673 | 4/1972 | Erickson | 226/136 X |
| 3,887,122 | 6/1975 | Sommeria | 226/136 |
| 3,904,099 | 9/1975 | Inoue | 226/134 |
| 4,029,250 | 6/1977 | Tall | 226/136 |

*Primary Examiner*—Richard A. Schacher

*Attorney, Agent, or Firm*—Kinney, Lange, Braddock, Westman and Fairbairn

[57] ABSTRACT

A film or paper drive system for use in photographic film or paper cutters allows the operator to position the film or paper accurately and rapidly by actuating a switch. The film or paper is driven a predetermined distance at a first rate in response to actuation of the switch. If the switch remains actuated after a first period, the film or paper is driven at a second rate. If the switch still remains actuated after a second period, the film or paper is driven at a third, higher rate.

19 Claims, 8 Drawing Figures

MULTIPLE SPEED WEB DRIVE SYSTEM

REFERENCE TO CO-PENDING APPLICATION

Reference is made to a co-pending application by W. Osby and G. Strunc Ser. No. 791,704 entitled "Semi Automatic Film Cutter with Movable Cursor" now U.S. Pat. No. 4,106,685 which is filed on even date and is assigned to the same assignee as the present application.

BACKGROUND OF THE INVENTION

The present invention relates to web drive systems. In particular, the present invention relates to web drive systems which allow an operator to accurately and rapidly position a photographic film or photographic print paper web in a photographic system such as a film or paper cutter.

In the photographic processing business, there is need for web drive systems which drive photographic film or photographic print paper by accurate distances. One particularly important application for such web drive systems is the field of photographic film cutters.

In commercial photographic processing operations, very high rates of processing must be achieved and maintained in order to operate profitably. In addition, quality of processing and care for the customer's film must be maintained at extremely high levels. These requirements apply particularly to the cutting of rolls of film into strips which will fit into the envelopes in which individual customers receive their orders.

In commercial film processing, as many as 500 to 1,000 rolls of 12, 20, and 36 exposure film are initially spliced together for processing and printing purposes. For a time during processing, the individual rolls of film lose their identity as part of a single, large roll. After prints have been made from the photographic film, the individual customer's film must be separated from the large roll of film and cut into strips of several frames each so that the strips can be placed flat in an envelope together with the prints.

The step of cutting the film into strips and cutting the film at splices to separate individual customer orders must be done very accurately. All cuts must be made between individual frames so that no picture is damaged.

A co-pending patent application, Ser. No. 627,526 filed Oct. 31, 1975, by Victor R. Baert and Ronald B. Harvey, which is assigned to the same assignee as the present application, describes a highly advantageous automatic web advancement and cutting system. In the system described in the Baert and Harvey application, indicia on the film are sensed by the advancement and cutting mechanism, and the feed length required to position the film correctly in relation to the cutting mechanism is determined by the indicia sensed.

Other film cutting apparatus which sense perforations or notches in the film and the splices between film rolls include U.S. Pat. Nos. 3,763,728 by Blackman and 3,793,915 by Hujer.

In these automatic film cutters, as well as in semiautomatic and manual film cutters there is a need for a web drive system which will allow the operator to adjust the position of the film rapidly and accurately. For example, the operator may need to move the film slightly in either the forward or reverse direction to facilitate original calibration or set-up of the cutter. Any adjustment of film position, therefore, must be very accurate. In addition, at the beginning of a roll of film, there may be a considerable length of leader or blank film. It is desirable for the operator to be able to rapidly advance the film past the leader so that normal operation of the cutter may begin.

SUMMARY OF THE INVENTION

The present invention is a web drive system which allows an operator to accurately and rapidly position a web of photographic material by actuating a switch. The web drive system of the present invention includes switch means, which has first and second states, and web drive means. The web drive means drives the web a predetermined distance at a first rate during a first period in response to the switch means switching to the second state. If the switch means is still in the second state after the first period, the web drive means drives the web at a second rate. In preferred embodiments, the web drive means will drive the web at a third, higher, rate if the switch means remains in the second state after a second period.

DETAILED DESCRIPTION OF THE PREFERRED EMBODIMENTS

Mechanical System

FIGS. 1–4 show a semiautomatic film cutter utilizing the web drive system of the present invention. It should be understood that the present invention may also be used to advantage in automatic and manual film cutters, and in other photographic systems such as paper cutters.

Figure 1:
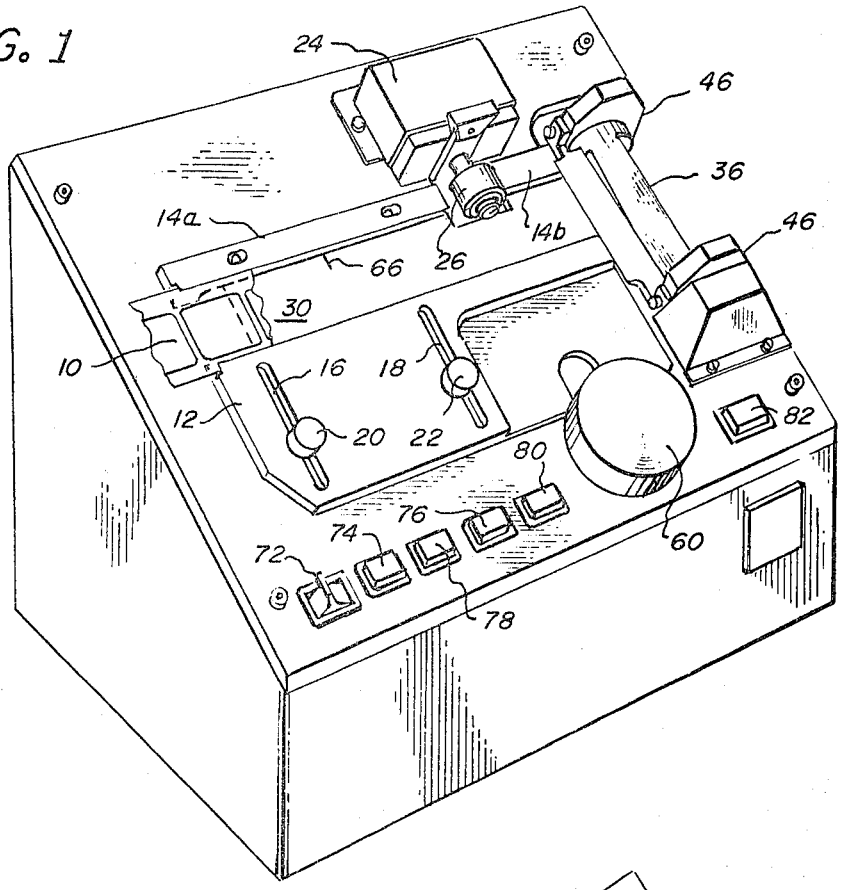
FIG. 1 is a perspective view of a semiautomatic film cutter utilizing the web drive system of the present invention.
Figure 3:
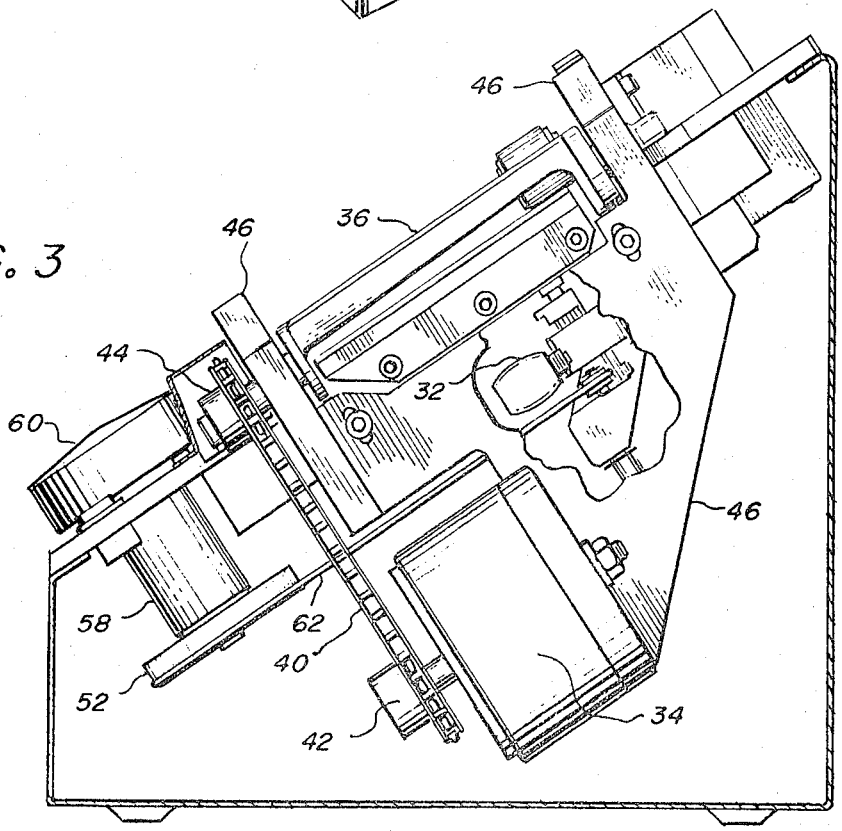
FIG. 3 is a side view of the top plate assembly shown in FIG. 2.
Figure 2:
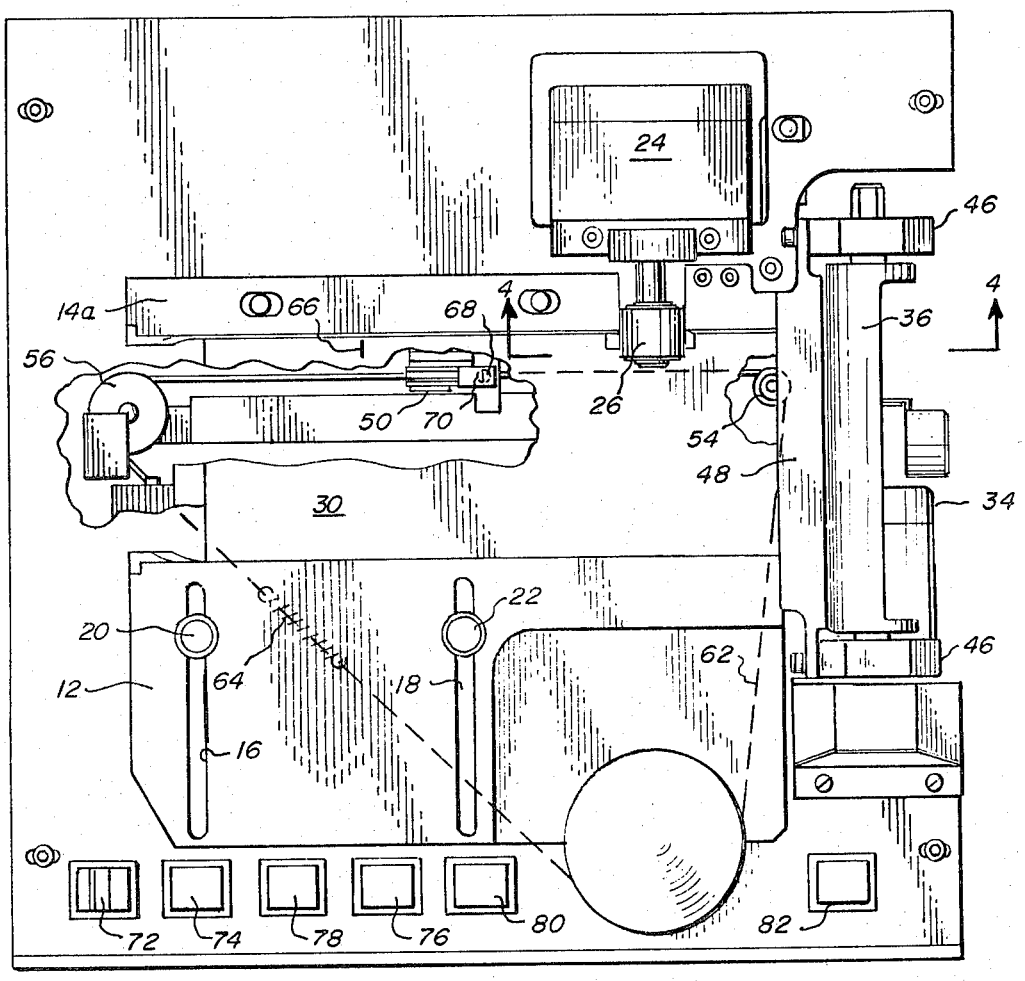
FIG. 2 is a top view of the top plate assembly of the semiautomatic film cutter of FIG. 1.
Figure 4:
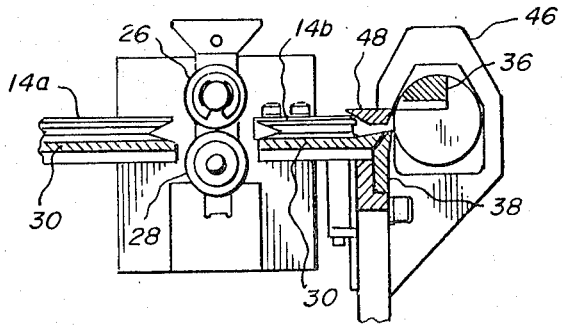
FIG. 4 is a fragmentary sectional view along section line 4—4 shown in FIG. 2.

In the perspective view shown in FIG. 1, photographic film 10 is shown being advanced in the film cutter. In the top view shown in FIG. 2, the side view shown in FIG. 3, and the detail cross-sectional view shown in FIG. 4, film 10 is not shown in order to better reveal portions of the semiautomatic film cutter.

Film 10 is supplied to the semiautomatic film cutter by a film supply (not shown) which may be of a conventional type. In a preferred embodiment, the film supply is a brake shoe type mechanism which mounts directly to the top plate of the semiautomatic film cutter.

Film 10 is guided along a film track by front guide 12 and rear guides 14*a* and 14*b*. Rear guides 14*a* and 14*b* are fixed while front guide 12 is movable to accommodate various film widths. Front guide 12 has two slots 16 and 18 which allow movement of front guide in a direction perpendicular to the direction of film movement. Front guide 12 is located by placing a piece of film between front guide 12 and rear guides 14*a* and 14*b* and securing front guide 12 in place by means of thumb screws 20 and 22. Front guide 12 is adjustable to handle film sizes from 110 to 70 mm in sleeved or unsleeved form.

Film 10 is driven by stepper motor 24 through a set of pinch rollers 26 and 28. Drive roller 26 is directly driven by stepper motor 24. Idler roller 26 has a lever which locates idler roller 26 in an engaged position for operation and in a disengaged position for loading film, shipping, and other non-operating modes. The position of rollers 26 and 28 is shown in greater detail in the partial cross-sectional view shown in FIG. 4.

The film track over which the film is driven includes a transparent or translucent plate 30. In one preferred embodiment, plate 30 is frosted plexiglass. Fluroescent lamp 32, which is mounted below plate 30, illuminates the film track and the film passing over the track. This allows the operator to view the film as it is advanced through the film cutter.

The film 10 is cut by a knife assembly mounted at one end of the film cutter. The knife assembly includes a rotary solenoid 34, rotary knife 36, fixed knife blade 38, a chain drive mechanism including drive chain 40 and sprockets 42 and 44 for driving the rotary knife 36 from the output of rotary solenoid 34, case mounting 46 for mounting the components of the knife assembly, and guard and deflector plate 48, which deflects film to the knife blades and acts as a guard to prevent operator injury. The knife assembly is capable of cutting all film sizes from 110 to 70 mm film in both sleeved and unsleeved form.

The feed length of the film is controlled by the cursor assembly, which includes movable cursor 50, drive pulley 52, idler pulley 54, encoder pulley 56, shaft 58, hand dial 60, belt 62, tensioning spring 64, and calibration mark 66. Movable cursor 50 is attached to belt 62 and is movable between pulleys 54 and 56 along a path which is essentially parallel to the path of the film along the film track. Movable cursor 50, which preferrably includes lamp 68 mounted behind slit 70, is mounted behind plexiglass plate 30 and is visible through plexiglass plate 30 and film 10.

The position of movable cursor 50 is controlled by hand dial 60, which drives pulley 52 by means of drive shaft 58. Clockwise rotation of hand dial 60 causes movable cursor 50 to move toward the knife assembly. Counter clockwise rotation of hand dial 60, on the other hand, causes movable cursor to move away from the knife assembly.

Movable cursor 50 is positioned or aligned with the location on film 10 where the next desired cut is to be made. The distance from movable cursor 50 to the knife assembly, therefore, is the desired feed length.

The position of movable cursor 50 and, therefore, the desired feed length, are determined by sensing the movement of cursor 50 from calibration mark 66. The movement of cursor 50 is detected by encoder pulley 56, which senses incremental rotation. A feed length signal indicative of the desired feed length is produced and stepper motor 26 is controlled to advance film 10 by the proper distance.

If film 10 is framed very consistently, as is the case with 110 and 126 format film, cursor 50 will not have to be moved between cuts. This allows essentially automatic operation of the film cutter so long as the framing remains consistent. Significant increases in speed can be obtained, therefore, over manual film cutters. Even in the case of film formats with inconsistent framing, the automatic film feed and cutting after positioning of movable cursor 50 permits higher speed operation than is possible with manual film cutters. The semiautomatic film cutter shown in FIGS. 1–4 has six switches located on the top plate of the cutter, together with a foot switch (not shown). Power switch 72 turns on the power to the semiautomatic film cutter. In the preferred embodiments, power switch 72 is a toggle switch.

After the power to the unit has been turned on, cursor 50 is set to calibration mark 66, which is marked on plexiglass plate 30. Calibration switch 74 is then pushed, thereby setting the cursor counting logic.

Film forward switch 76 is a push button switch which advances film 10 by one step of stepper motor 24. If film forward switch 76 continues to be held in the down position after a first predetermined period of time, stepper motor 24 steps one step at a time for 64 steps at a rate of 25 steps per second. If film forward switch 76 still remains in the down position after the 64 steps have been completed, stepper motor 24 steps at a rate of 500 steps per second. This faster speed is used for passing rolls of blank film or leader.

Film reverse switch 78 has the same function as film forward switch 76, except that film 10 moves in the reverse rather than the forward direction. Like film forward switch 76, film reverse switch 78 is preferably a push button switch.

Trim switch 80 is a push button switch which energizes rotary solenoid 34. Trim switch 80, therefore, allows the operator to operate the knife assembly independent of the film drive mechanism.

Start switch 82 is a push button switch which starts a film feed and cut cycle. Start switch 82 must be actuated for every cycle. If film 10 is framed very consistently, such as is the case with 110 and 126 format film, start switch 82 may be held in the actuate or down position, and the semiautomatic film cutter will repeat the feed and cut cycles as long as start switch 82 remains actuated.

The foot switch (not shown) operates in the same manner as start switch 82. The foot switch allows the operator to initiate film feed and cut cycles without the use of hands.

The typical mode of operation of the semiautomatic film cutter shown in FIGS. 1–4 is as follows: First, the operator turns on the power by switching power switch 72 to the on position. Second, front film guide 12 is set to the appropriate position to accommodate the particular width of film 10. Third, movable cursor 50 is moved to the calibrate position indicated by calibration mark 66, and calibration switch 74 is pushed to set the film feed logic. Fourth, dial 60 is rotated to position cursor 50 between frames of film 10 at the desired cut location. Fifth, start switch 82 (or the foot switch) is depressed, thereby commencing a film feed and cut cycle. If required, cursor 50 may have to be set prior to each film feed and cut cycle. If, however, the film is framed very consistently, the operator may maintain start switch 82 or the foot switch in the actuate position, thereby initiating repeated film feed and cut cycles with the same film feed length for each cycle.

Electrical System

FIGS. 5–8 show electrical schematic diagrams of the control circuitry of the semiautomatic film cutter. The circuit of FIG. 5 receives signals $\overline{\phi A}$ and $\overline{\phi B}$ from the bidirectional encoder associated with encoder pulley 56. Inverter 84 inverts $\overline{\phi A}$ to produce the $\phi A$ signal, and inverter 86 inverts the $\overline{\phi B}$ signal to produce the $\phi B$ signal. The $\phi A$ and $\phi B$ signals are suppied to a count up pulse generator formed by flipflops 88, 90 and 92, and gate 94.

The output of inverter 84 is also inverted by inverter 96 to produce again the $\overline{\phi A}$ signal. A count down pulse generator formed by flipflops 98, 100, and 102, and NAND gate 104 receives the $\overline{\phi A}$ and $\phi B$ signals.

The count up and count down pulse generators produce pulses depending upon the state of $\phi B$ when $\phi A$ goes high (and, therefore, when $\overline{\phi A}$ goes low). If $\phi B$ leads $\phi A$, the count up pulse generator produces a count up pulse. Conversely, if $\phi A$ leads $\phi B$, the count down pulse generator produces a count down pulse.

The count up and count down signals are supplied to a three stage counter formed by counters 106, 108, and 110. The count up and count down pulses increment and decrement, respectively, the count stored in counters 106, 108, and 110. The initial count has been set in counters 106, 108, and 110 by switches S1-S12 and resistors R1-R12. Selected ones of switches of S1-S12 are c osed to provide a binary coded decimal count which corresponds to the initial cursor calibration position. All counting up or down is from this initial cursor calibration position.

The count up and count down pulse generators include reset circuitry for resetting flipflops 88 and 98. The count up pulse generator is reset after a count up pulse is generated because the $\overline{Q}$ output of flipflop 92 is connected to one input of NOR gate 112. Similarly, flipflop 98 of the countdown pulse generator is reset by NOR gate 114 after a countdown pulse is produced because the $\overline{Q}$ output of flipflop 102 is connected to one input of NOR gate 114.

The count up and count down pulse generators may also be reset by an external reset signal $\overline{ERST}$. The $\overline{ERST}$ signal is inverted by inverter 116 to produce the RST signal which resets flipflops 90, 92, 100, and 102. The RST signal is inverted by inverter 118 to produce the $\overline{RST}$ signal, which is provided to inputs of NOR gates 112 and 114 thereby causing flipflops 88 and 98 to be reset.

Figure 5:
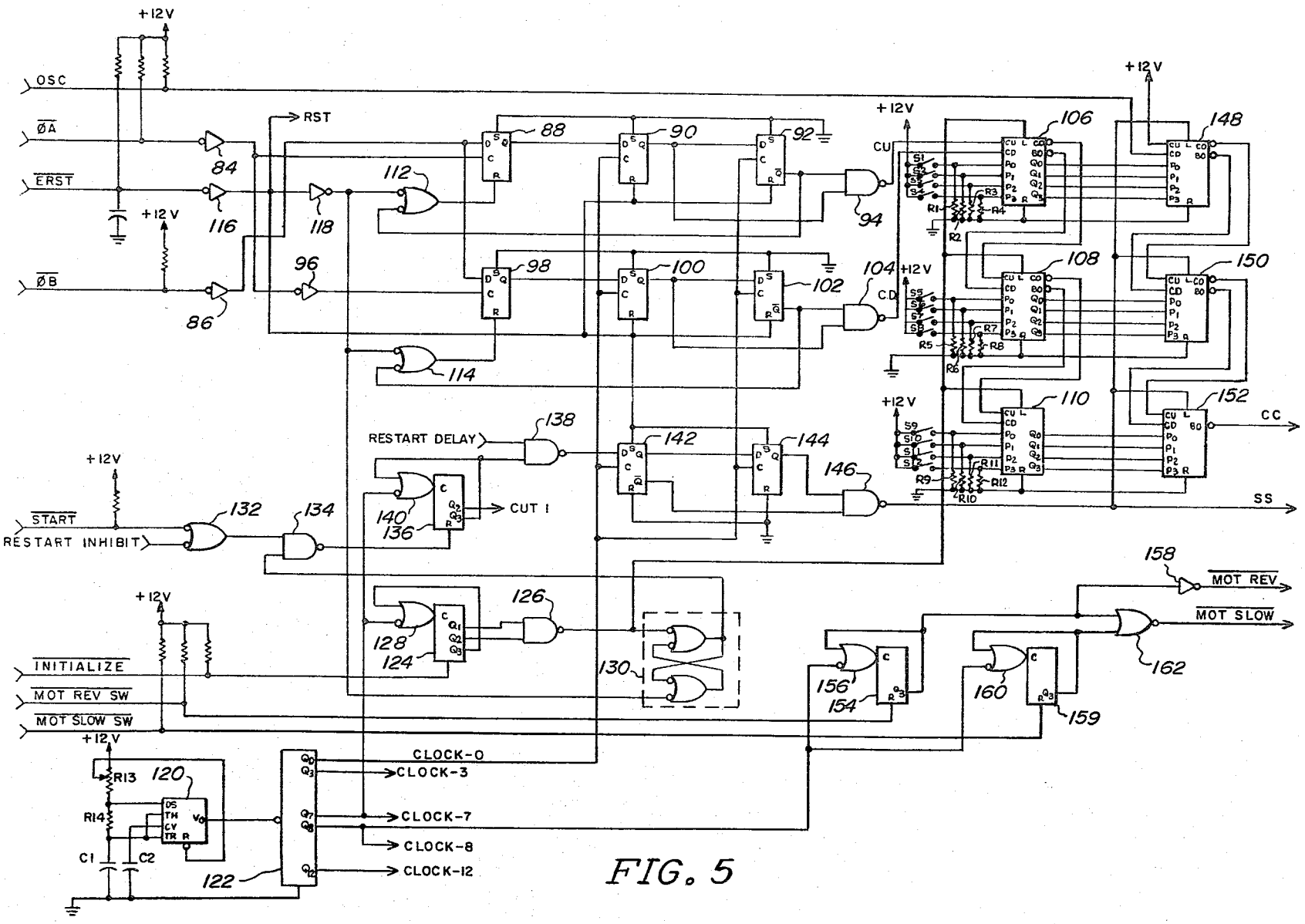
FIGS. 5–8 are electrical schematic diagrams for a semiautomatic film cutter utilizing the web drive system of the present invention.

The circuit of FIG. 5 also includes a clock circuit formed by resistors R13 and R14, capacitors C1 and C2, master clock oscillator 120, and binary counter 122. Various outputs of binary counter 122 are used to produce clock signals of various frequencies. The highest frequency output signal from binary counter 122 drives flipflops 90, 92, 100, and 102.

As previously described, an initial step in the operation of the semiautomatic film cutter is to set cursor 50 to calibrate position 66 and then to push calibrate switch 74. Pushing calibrate switch 74 causes the $\overline{INITIALIZE}$ signal to go low. The $\overline{INITIALIZE}$ signal is supplied to an initialize debounce circuit formed by counter 124, NAND gate 126, and NOR gate 128.

Then the $\overline{INITIALIZE}$ signal goes low, it removes the reset from counter 124 and allows counter 124 to be incremented in response to a clock signal from counter 122. If the $\overline{INITIALIZE}$ signal remains low for a sufficient period of time for counter 124 to count up so that both the Q1 and Q2 outputs go high, NAND gate 126 will produce an initialize pulse. This initialize pulse is supplied to the load inputs of counters 106, 108, and 110, and causes counters 106, 108, and 110 to accept the initial count determined by switches S1-S12. The initialize pulse also sets cursor initialize flipflop 128.

Once the initial count has been loaded in counters 106, 108, and 110, movement of the cursor will cause production of either count up or count down pulses which increment or decrement the count in counters 106, 108, and 110.

After the cursor has been moved to the desired cut position, the operator pushes start switch 82 or depresses the foot switch. In either case, this causes the $\overline{START}$ signal to go low. The $\overline{START}$ signal is NORed by NOR gate 132 with the RESTART INHIBIT signal. The output of NOR gate 132 is NANDed with the output of cursor initialized flipflop 130. Only when cursor initialized flipflop 130 is set will the $\overline{START}$ signal be allowed to start operation of the film cutter.

The output of NAND gate 134 is supplied to a start debounce circuit formed by counter 136, NAND gate 138 and NOR 140. The start debounce circuit operates in a generally similar fashion to the initialize debounce circuit. The start debounce circuit differs, however, in that the $Q_3$ output of counter 136 is applied to one input of NAND gate 138 and the RESTART DELAY signal is applied to the other input of NAND gate 138. Then the RESTART DELAY signal is high and output $Q_3$ of counter 136 goes high, the start debounce circuit produces a low going pulse which is supplied to a load and start pulse generator formed by flipflop 142 and 144 and NAND gate 146.

Figure 6:
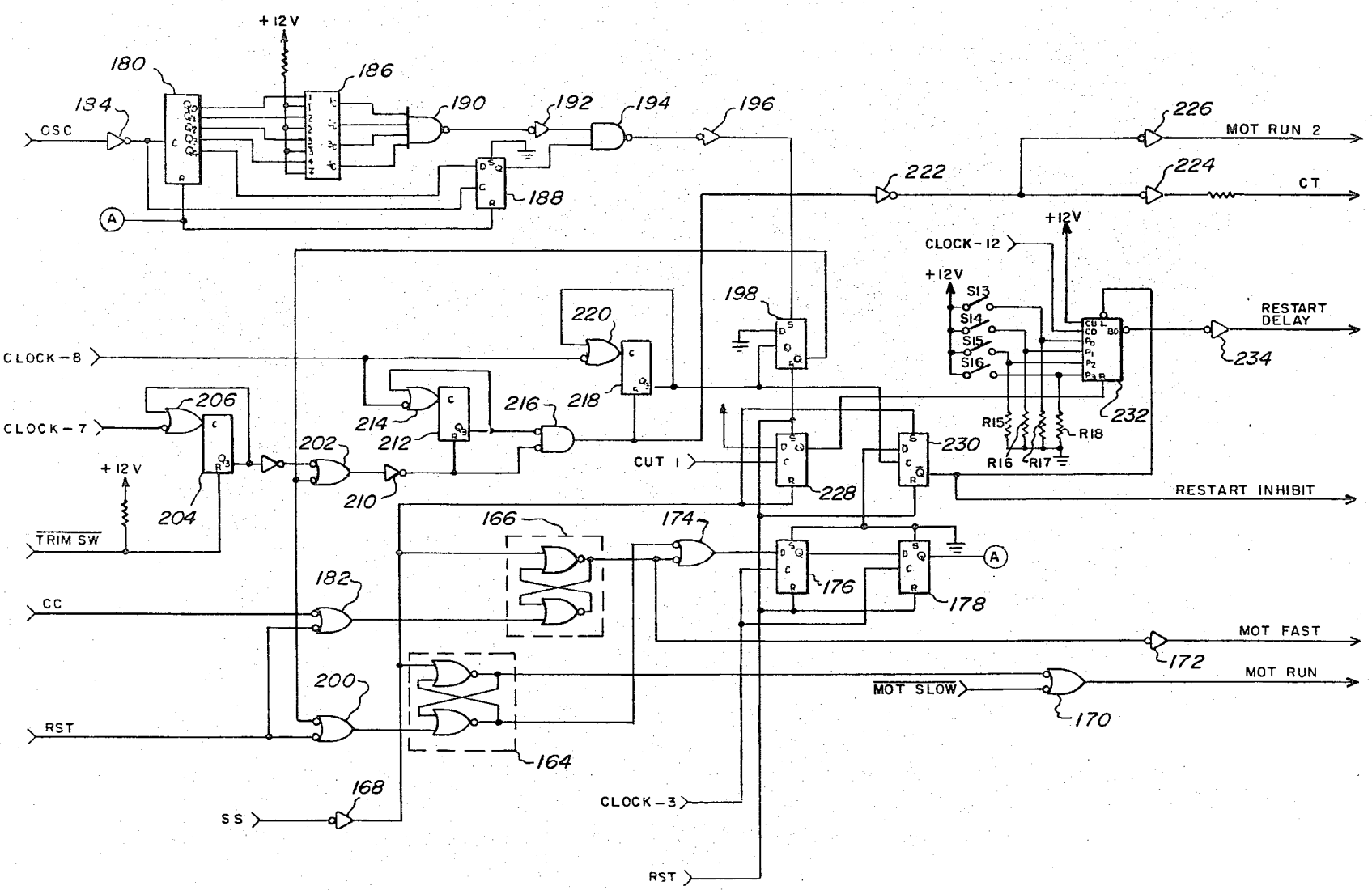

The output of the load and start pulse generator is the SS signal which is supplied to the circuitry of FIG. 6. The SS signal is also supplied to the load inputs of counters 148, 150, and 152, and causes counters 148, 150, and 152 to accept the count then contained in counters 106, 108 and 110.

The OSC signal, which corresponds to the steps of the stepper motor drive, is applied to the count down input of counter 148. The OSC signal causes counters 148, 150, and 152 to count down to zero from the count received from counters 106, 108, and 110. When counters 148, 150, and 152 have been decremented to zero, the CC signal from counter 152 changes state. The CC signal is supplied to the circuitry shown in FIG. 6 and ultimately causes the film drive to stop.

FIG. 5 also shows the circuitry which produces the $\overline{MOT\ REV}$ and $\overline{MOT\ SLOW}$ signals. The $\overline{MOT\ REV}$ signal is produced by a motor reverse debounce circuit formed by counter 154 and NOR gate 156. When the $\overline{MOT\ REV\ SW}$ signal goes low, which occurs when the film reverse switch 78 is depressed, the motor reverse debounce circuit produces an output signal which is inverted by inverter 158 to produce the $\overline{MOT\ REV}$ signal.

The $\overline{MOT\ SLOW}$ signal is produced by the motor slow debounce circuit formed by counter 159 and NOR gate 160, together with NOR gate 162. The output of the motor slow debounce circuit is applied to one input of NOR gate 162. The other input to NOR gate 162 is the output of the motor reverse debounce circuit. The $\overline{MOT\ SLOW}$ signal, therefore, is produced whenever either the $\overline{MOT\ SLOW\ SW}$ signal goes low (i.e. film forward switch 76 is depressed) or the $\overline{MOT\ REV\ SW}$ signal goes low (i.e. film reverse switch 78 is depressed).

FIG. 6 shows the circuitry which produces the MOT RUN2, CT, RESTART DELAY, RESTART INHIBIT, MOT FAST, and MOT RUN signals. Circuit of FIG. 6 includes MOT RUN flipflop 164 and MOT FAST flipflop 166. The SS signal (which is produced by the load and start pulse generator shown in FIG. 5) is inverted by inverter 168 and applied to the set inputs of MOT RUN flipflop 164 and MOT FAST flipflop 166. Flipflops 164 and 166, therefore, are set when the start switch 82 has been depressed and the load and start pulse generator has produced the SS signal pulse. The Q output of MOT RUN flipflop 164, which is low when the flipflop is set, in NORed with the $\overline{\text{MOT SLOW}}$ signal by NOR gate 170 to produce the MOT RUN signal.

The output of MOT FAST flipflop 166 is inverted by inverter 172 to produce the MOT FAST signal. In addition, the output of MOT FAST flipflop 166 is NORed with the $\overline{Q}$ output of MOT RUN flipflop 164 by NOR gate 174.

As long as MOT FAST flipflop 166 remains set, the output of NOR gate 174 remains high. The output of NOR gate 174 is supplied to the D input of flipflop 176, whose output, in turn, is supplied to the D input of flipflop 178. As long as the output of NOR gate 174 remains high, the output of flipflop 178 remains high.

The output of flipflop 178 is connected to the reset terminal of ramp down and stop adjust counter 180. When the output of flipflop 178 is high, therefore, the reset to counter 180 remains high and counter 180 is inhibited from operation.

MOT FAST flipflop 166 is reset by the output of NOR gate 182. The inputs from NOR gate 182 are the CC signal, which goes low when counters 148, 150, and 154 are counted to zero, and the RST signals, which is a reset signal. In normal operation, MOT FAST flipflop 166 will be set by the SS signal to inverter 168 and will be reset by the CC signal through NOR gate 182.

When MOT FAST flipflop 166 is reset, its output goes high and the output of NOR gate 174 goes low. This causes the output of flipflop 178 to go low, thereby removing the reset from ramp down and stop adjust counter 180.

Figure 7:
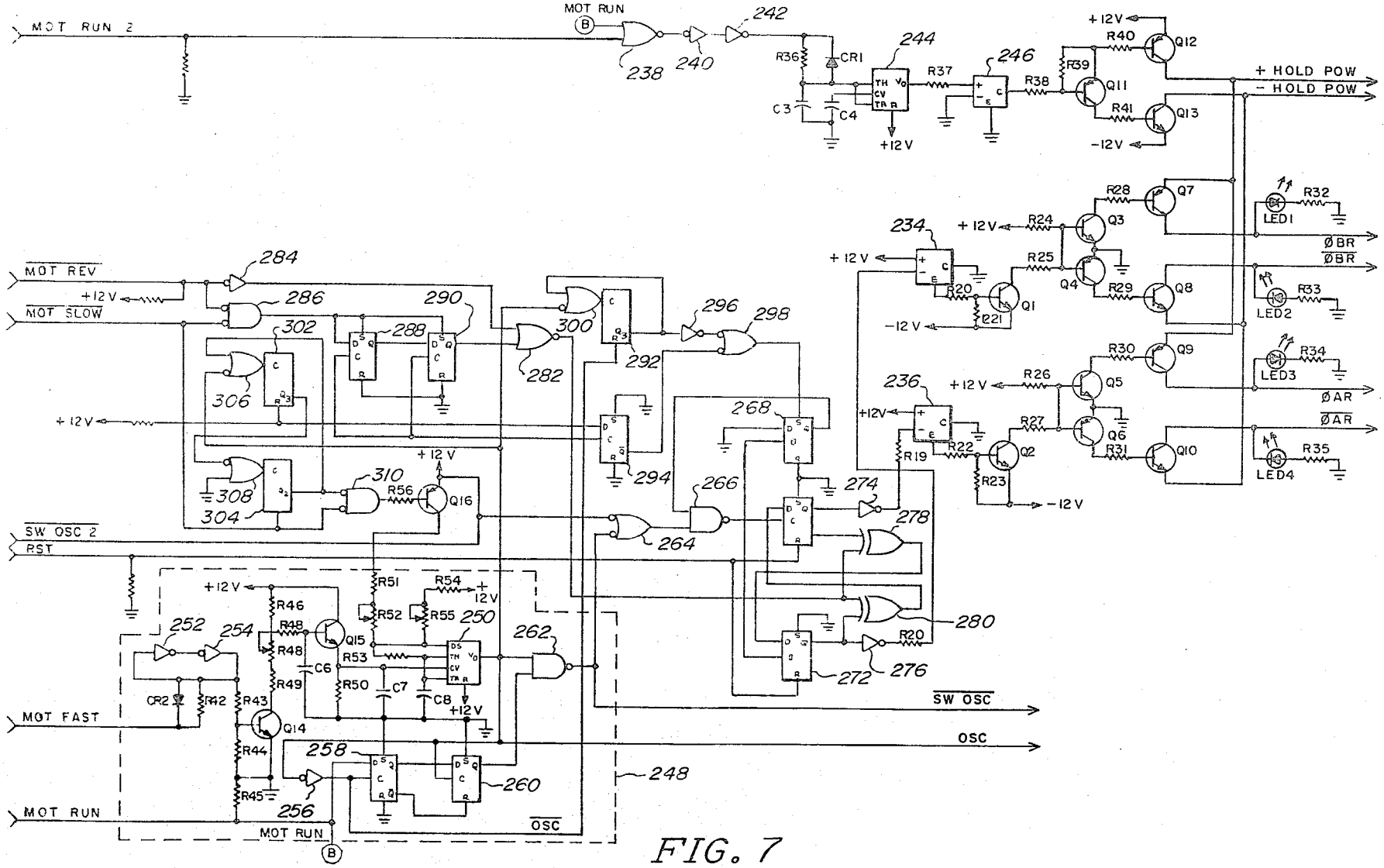

With the reset removed, counter 180 begins to count in response to the OSC signal, which is applied to the clock input of counter 180 by inverter 184. As previously discussed, the OSC signal, which is generated in the circuit shown in FIG. 7, provides a pulse for each step of stepper motor operation.

The first four outputs of counter 180 are applied to stop adjust switch 186, which is a hex decimal switch. The fifth output from counter 180 is applied to the D input of flipflop 188. The fifth output goes high when counter 180 has counted to sixteen.

In the embodiment shown in FIG. 6, the first four outputs of counter 180 must all be high in order to produce four high outputs from stop adjust switch 186. When this occurs, the output of NAND gate 190 goes low and the output of inverter 192 goes high. This provides a high input to NAND gate 194.

The other input to NAND gate 194 is received from the Q output of flipflop 188. Flipflop 188 is clocked by the OSC signal, which has been inverted by inverter 184. The output of flipflop 188, however, remains low until the fifth output of counter 180 goes high. At that time, the Q output of flipflop 188 goes high.

When both inputs of NAND gate 194 go high, the output goes low. This causes the output of inverter 196 to go high, thereby providing a set signal to flipflop 198. When flipflop 198 is set, its $\overline{Q}$ output goes low. The $\overline{Q}$ output of flipflop 198 is connected to an input of NOR gate 200, whose output is connected to the reset terminal of MOT RUN flipflop 164. When the $\overline{Q}$ output of 198 goes low, therefore, MOT RUN flipflop 164 is reset and the MOT RUN signal changes state. In addition, the $\overline{Q}$ output of MOT RUN flipflop 164, which changes to low state when MOT RUN flipflop 164 is reset, causes the output of NOR gate 174 to again go high. This, in turn, causes the output of flipflop 178 to go high, thereby reapplying the reset signal to counter 180 and flipflop 188.

Figure 8:
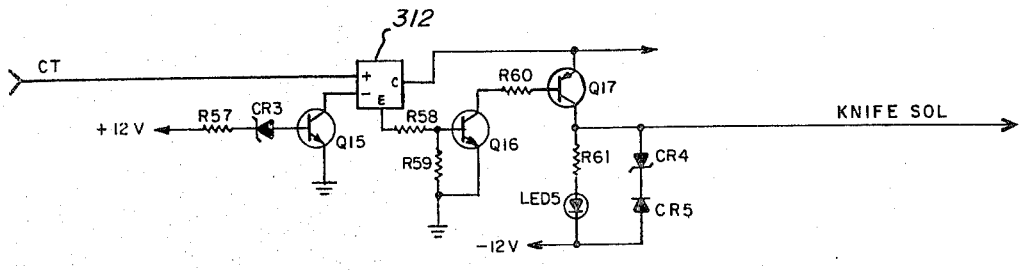

The CT signal, which is a high-going pulse used by the circuitry of FIG. 8 to actuate the knife solenoid, is generated automatically at the end of a film feed cycle or manually by depressing the trim switch 80. The normal actuation of the knife solenoid at the end of an operating cycle is derived from the $\overline{Q}$ output of flipflop 198, which goes low when counter 180 has counted a desired number of steps after the CC signal. The $\overline{Q}$ output of flipflop 198 also is connected to NOR gate 202, so that when the $\overline{Q}$ output of flipflop 198 goes low, the output of NOR gate 202 goes high.

The other input to NOR gate 202 is derived from the $\overline{\text{TRIM SW}}$ signal from trim switch 80. When the $\overline{\text{TRIM SW}}$ signal goes low, it removes the reset from counter 204 of a trim switch debounce circuit including counter 204, NOR gate 206, and inverter 208. When the output of inverter 208 goes low, it causes the output of NOR gate 202 to go high.

The output of NOR gate 202 is applied through inverter 210 to the reset terminal of counter 212. The reset to counter 212, therefore, is removed when trim switch 80 is pressed or when the $\overline{Q}$ output of flipflop 198 goes low. This allows counter 212 to count in response to clock signals applied to one terminal of NOR gate 214. When counter 212 reaches the desired count, the output is fed back through the other input to gate 214 to terminate counting.

NAND gate 216 receives the output of inverter 210 and the output of counter 212. When the output of inverter 210 goes low, thereby removing the reset from counter 212, the output of NAND gate 216 goes high. It remains high until the output of counter 212 goes high. The duration of the high output pulse from NAND gate 16, therefore, is determined by the particular outputs selected from counter 212 and the frequency of the clock pulses to NOR gate 214.

The high pulse from NAND gate 216 resets counter 218. The output of counter 218 is reset to a low state and clock pulses supplied to NOR gate 220 cause counter 218 to count. When the output of counter 218 goes high, it supplies a clock pulse to flipflop 198. This causes the $\overline{Q}$ output of flipflop 198 to again go high, thereby removing the low input to NOR gate 202.

The output of NAND gate 216 is inverted by inverter 222 and is again inverted by inverter buffer 224 to produce the CT signal. Inverter buffer 226 also receives the output of inverter 222 and produces the MOT RUN 2 signal.

Also shown in FIG. 6 is a circuit which provides the RESTART INHIBIT and RESTART DELAY signals. This circuit includes flipflops 228 and 230, switches S13-S16, resistors R15-R18, counter 232, and buffer inverter 234.

The SS signal (which is produced when the start switch is depressed) resets flipflop 228. When the CUT 1 signal, which is the output of start debounce counter 136 of FIG. 5, goes high, the output of flipflop 228 goes high, thereby applying a reset pulse to counter 232.

The SS signal, as inverted by inverter 168, also is applied to the set input of flipflop 230. This causes the $\overline{Q}$ output of flipflop 230 to go low. The $\overline{Q}$ output of flipflop 230 is the RESTART INHIBIT signal which is supplied to NOR gate 132 in FIG. 5. In addition, the $\overline{Q}$ output is connected to the load input of counter 232.

When the $\overline{Q}$ output of flipflop 230 is low, it causes counter 232 to load the count set by switches S13-S16.

The $\overline{Q}$ output of flipflop 230 switches from the low to a high state when the clock input of flipflop 230 goes high. The clock input of 230 is connected to the output of counter 218. The output of counter 218 goes high a predetermined time after the CT and MOT RUN 2 pulses have been produced. This delay produced by counter 218 insures that the knife is returned to rest position before the operator can restart the cutter.

When the $\overline{Q}$ output of flipflop 230 goes high, counter 232 is allowed to count down in response to clock signals from counter 122 of FIG. 5. When counter 232 reaches zero, the output of inverter 234, which is the RESTART DELAY signal, goes high.

The effect of the RESTART DELAY signal may be seen by referring again to FIG. 5. Then the $\overline{Q}$ output of flipflop 230 goes high, the RESTART INHIBIT signal applied to NOR gate 132 goes high. The output of NOR gate 132 remains high, therefore, only as long as the $\overline{\text{START}}$ signal remains low. Similarly, the output of NAND gate 134 will remain low, thereby removing the reset from start debounce counter 136, as long as the $\overline{\text{START}}$ signal remains low.

When the RESTART DELAY signal goes high, it causes another load and start pulse to be produced by flipflops 142 and 144, and NAND gate 146, provided that the output of counter 136 is still high. This will only occur, however, if the start switch 82 remains depressed and the $\overline{\text{START}}$ signal is low until the RESTART DELAY signal goes high. If these conditions are met, another load and start pulse is produced and another film feed and cut cycle is commenced.

FIG. 7 shows the stepper motor drive circuitry which drives the stepper motor. The stepper motor is controlled by the $\phi$AR, $\overline{\phi\text{AR}}$, $\phi$BR and $\overline{\phi\text{BR}}$ signals. When the $\phi$AR signal leads the $\phi$BR signal, the stepper motor is caused to step in a clockwise direction. Conversely, if $\phi$BR leads $\phi$AR, the motor steps in a counter-clockwise direction.

The $\phi$AR, $\overline{\phi\text{AR}}$, $\phi$BR, and $\overline{\phi\text{BR}}$ signals are produced by the stepper motor drive circuit which includes optoisolators 234 and 236, resistors R19-R35, and light emitting diodes LED1-LED4. Power is supplied to the drive circuit by the circuit including NOR gate 238, inverters 240 and 242, stepper motor power shutdown timer 244, optoisolator 246, resistors R36-R41, capacitors C3 and C4, diode CR1 and transistors Q11-Q13. Power is supplied by the outputs of transistors Q12 and Q13 so long as either the MOT RUN or MOT RUN 2 signal is high. If both MOT RUN and MOT RUN 2 are low, thereby indicating that no further motion of the stepper motor is desired, Q12 and Q13 are turned off after a time delay produced by stepper motor power shutdown timer 244.

The operation of the stepper motor driver circuitry is controlled by the remaining circuitry shown in FIG. 7. This circuitry receives the $\overline{\text{MOT REV}}$, $\overline{\text{MOT SLOW}}$, $\overline{\text{SW OSC 2}}$, RST, MOT FAST, and MOT RUN signals. Depending upon the state of these various signals, a low input signal is supplied to either optoisolator 234 or optoisolator 236.

The circuitry includes a stepper motor oscillator circuit 248 formed by stepper motor oscillator 250, inverters 252, 254, and 256, flipflops 258 and 260, transistors Q14 and Q15, diode CR2, capacitors C6-C8, and resistors R42-R55 and NAND gate 262.

During a normal film feed and cut cycle, the MOT FAST and MOT RUN signals, which are produced by the circuit shown in FIG. 6, go high. When the MOT FAST signal goes high, it causes transistor Q14 to turn on, which discharges capacitor C6 and gradually decreases the base voltage on transistor Q15. As Q15 base voltage decreases, the voltage at the CV input of stepper motor oscillator 250 decreases, thereby causing an increase in frequency of the stepper motor oscillator 250 from the idle speed of about 500 Hz to the fast speed of about 2000 Hz.

As the end of a film feed cycle is approached and the CC signal is produced by counter 152 of FIG. 5, the MOTOR FAST flipflop 166 of FIG. 6 is reset and the MOT FAST signal goes low. This causes transistor Q14 to turn off and transistor Q15 base voltage to begin to increase. As transistor Q15 base voltage increases, the voltage at the CV input of stepper motor oscillator 250 rises, and the output frequency of oscillator 250 decreases from 2000 Hz to the idle speed of 500 Hz.

The output of stepper motor oscillator 250 is the OSC signal which is supplied to the circuit shown in FIGS. 5 and 6. The OSC signal is also supplied to several portions of the circuitry shown in FIG. 7.

The OSC signal is supplied, through inverter 256, to the clock input of flipflop 258, and the MOT RUN signal is supplied to the D input of flipflop 258. The Q output of flipflop 258 is supplied to D input of flipflop 260. The $\overline{Q}$ of 258 is connected to reset input of flipflop 260, and the OSC signal is supplied to the clock input of flipflop 260. Output of flipflop 260 is NANDed with the OSC signal by NAND gate 262.

The effect of inverter 256, flipflop 258, 260 and NAND gate 262 is twofold. First, the output pulses from NAND gate 262 are produced only when the MOT RUN signal is high. The frequency of the output pulses of NAND gate are determined by the frequency of the OSC signal. Second, inverter 256 and flipflops 258 and 260 provide a synchronizing circuit which synchronize the MOT RUN signal with the OSC signal so that when the MOT RUN signal goes high for the first time, the two inputs to NAND gate 262 will go high together. It was found that this was preferable to simply NANDing the MOT RUN signal with OSC signal.

The output of NAND gate 262 is the $\overline{\text{SW OSC}}$ signal, which is supplied to one input of NOR gate 264. The other input to NOR gate 264 is the $\overline{\text{SW OSC 2}}$ signal. The $\overline{\text{SW OSC 2}}$ signal allows the semi-automatic film cutter to be slaved to another stepper motor in another machine so that the operation of the semi-automatic film cutter may be synchronized with that other machine. When no synchronization of machines is desired, the $\overline{\text{SW OSC 2}}$ signal remains high through the action of a pullup resistor, and the $\overline{\text{SW OSC}}$ signal from NAND gate 262 controls the output state or NOR gate 264.

The output of NOR gate 264 is applied to one input of NAND gate 266. The other input to NAND gate 266 is the Q output of flipflop 268. During a normal film feed cut cycle, the Q output of flipflop 268 is high, so that the output of NOR 264 controls the output state of NAND gate 266.

The output of NAND gate 266 is supplied to the clock input of flipflops 268, 270, and 272. The Q output of flipflop 270 is inverted by inverter buffer 274 and supplied through resistor R19 to optoisolator 236. Similarly, the Q output of flipflop 272 is inverted by inverter buffer 276 and supplied through resistor R20 to optoisolator 234. The outputs of flipflops 270 and 272, therefore, ultimately control the $\phi AR$, $\overline{\phi AR}$, $\phi BR$, and $\overline{\phi BR}$ signals and determine whether the stepper motor steps in a clockwise or in a counterclockwise direction.

During a normal film feed and cut cycle, the film is only driven forward and the stepper motor steps in only one direction. The outputs of flipflops 270 and 272 and the $\phi AR$, $\overline{\phi AR}$, $\phi BR$, and $\overline{\phi BR}$ signals always have the same phase relationships during the film feed and cut mode of operation.

The control of stepper motor direction is, however, important when the operator is using film forward switch 76 or film reverse switch 78 to position the film. The stepper motor direction in this mode of operation is controlled by a circuit including flipflops 270 and 272, exclusive OR gates 278 and 280, NOR gate 282, inverter 284, NAND gate 286, and flipflops 288 and 290.

The Q output of flipflops 270 and 272 and, therefore, the direction of the stepper motor drive is controlled by exclusive OR gates 278 and 280. One input to exclusive OR 278 is the $\overline{Q}$ of flipflop 270, and the other input is the output of NOR gate 282. The output of exclusive OR 278 is connected to the D input of flipflop 272.

The two inputs to exclusive OR 280 are the Q output of flipflop 272 and the output of NOR gate 282. The output of exclusive OR 280 is connected to the D input of flipflop 270.

The output state of NOR gate 282, therefore, effectively selects the direction of stepper motor drive through exclusive OR gates 278 and 280, which are connected to the D inputs of flipflops 272 and 270, respectively. The output state of NOR gate 282 controls the outputs of exclusive OR gates 278 and 280, thereby controlling the phase of the Q outputs of flipflops 270 and 272.

The $\overline{\text{MOT REV}}$ signal is inverted by inverter 284 and supplied to one input of NOR gate 282. The $\overline{\text{MOT REV}}$ signal is also NANDed by NAND gate 286 with the $\overline{\text{MOT SLOW}}$ signal and supplied through the delay circuit formed by flipflops 288 and 290 to the other input of NOR gate 282. The state of the $\overline{\text{MOT REV}}$ signal, therefore, controls the output of NOR gate 282, thereby controlling the direction of stepper motor drive.

The delay provided by flipflops 288 and 290 assures that the direction signal from 282 is not removed from exclusive ORs 278 and 280 until after turnoff. This prevents any random oscillation in stepper motor drive direction at the end of a film feed cycle.

The remaining circuitry shown in FIG. 7 also relates to the operation of the film forward and film reverse switches. As previously discussed, the pressing film forward switch 76 causes the film to advance by one stepper motor step. Switch 76 is continuously held in the down position, the stepper motor will then drive the film one step at a time for 64 steps at a rate of 25 steps per second. The stepper motor will then step at a rate of 500 steps per second until the film forward switch 76 is released. Similar operation in a reverse direction is provided by film reverse switch 78.

When either film forward switch 76 or film reverse switch 78 is pressed the $\overline{\text{MOT SLOW}}$ signal goes low. In addition, the $\overline{\text{MOT REV}}$ signal will be high if film forward switch 76 is being depressed and will be low if film reverse switch 78 is being depressed.

The $\overline{\text{MOT SLOW}}$ signal is NORed by NOR gate 170 in FIG. 6 with the output of motor run flipflop. When the $\overline{\text{MOT SLOW}}$ signal goes low, the MOT RUN signal goes high, thereby causing oscillator 248 to begin operation.

When the $\overline{\text{MOT SLOW}}$ signal goes low, it removes the reset from single step counter 292 and supplies a low signal to the D input of flipflop 294. Counter 292, flipflop 294, and flipflop 268 together with inverter 296, NOR gate 298, and NOR gate 300, form a single step count circuit which provides a single stepper motor step when either the film forward switch 76 or the film reverse switch 78 is initially depressed.

Prior to the $\overline{\text{MOT SLOW}}$ signal going low, the Q3 output of counter 292 is normally zero. This output is inverted by inverter 296 and applied to one input of NOR gate 298. The other input to NOR gate 298 is the $\overline{Q}$ output of flipflop 294. When the $\overline{\text{MOT SLOW}}$ signal is high, the $\overline{Q}$ output of flipflop 294 is low, so that the output of NOR gate 298 is normally high. This normally high output is connected to the set input of flipflop 268, which causes a high signal to be supplied to one input of NAND gate 266. This allows NAND gate 266 to supply clock pulses to flipflops 270 and 272.

When the $\overline{\text{MOT SLOW}}$ signal is low, the $\overline{Q}$ output of flipflop 294 goes high, thereby causing the set input to flipflop 268 to go low. When a clock pulse from NAND gate 266 is received by flipflop 268, the Q output goes low, thereby preventing NAND gate 266 from producing any further pulses after the first clock pulse.

Counter 292 counts up in response to the OSC signal which is applied through NOR gate 300 to the clock input of counter 292. If the $\overline{\text{MOT SLOW}}$ signal remains low (i.e. the film forward switch 76 or film reverse switch 78 remains depressed) until counter 292 counts to eight, Q3 output counter 292 goes high. The Q3 output is fed back to NOR gate 300 and inhibits any further counting. In addition, when Q3 output of counter 292 goes high, the output of NOR gate 298 again goes high, thereby reestablishing the high set input to flipflop 268.

The effect of this single step counting circuit is to allow only one step of the stepper motor during the time required for counter 292 to count to eight. If this first time period elapses and the $\overline{\text{MOT SLOW}}$ signal is still low, the stepper motor is again allowed to operate. During this second time period, the stepper motor operates at a rate of 25 steps per second for a total of 56 steps. The slow speed counter circuit formed by counters 302 and 304, NOR gate 306 and 308, NAND gate 310, resistor R56, and transistor Q16 provide this slow speed operation.

When the $\overline{\text{MOT SLOW}}$ signal goes low, it removes the reset from counters 302 and 304. Counters 302 and 304, therefore, begin to count in response to the OSC signal. The Q2 output of counter 304 is fed back to an input of NOR gate 306 so that the operation of counters 302 and 304 is inhibited when the Q2 output of counter 304 goes high.

The output frequency of the OSC signals from oscillator circuit 248 is controlled by transistor Q16. When the $\overline{\text{MOT SLOW}}$ signal goes low, it causes the output of NAND gate 310 to go high, thereby turning transistor Q16 off. When Q16 turns off, it effectively disconnects resistors R51 and R52 from the stepper motor oscillator 250. Resistors 51 and 52 determine the idle speed of oscillator 250, which is preferably 500 Hz.

With transistor Q16 turned off, the frequency of oscillator 250 is determined by resistors R54 and R55. In a preferred embodiment, resistors R54 and R55 have been selected so that the output of oscillator 250 has a frequency of 25 Hz when transistor Q16 is turned off.

Transistor Q16 remains turned off until the $\overline{\text{MOT SLOW}}$ signal goes high or the Q2 output of counter 304 goes high. If the film forward switch 76 of the film reverse switch 78 remains depressed for a time period sufficient to allow ounters 302 and 304 to count to 64, transistor Q16 is again turned on and the OSC signal from stepper motor oscillator 250 increases to 500 Hz. The stepper motor, therefore, continues to operate at 500 steps per second until the $\overline{\text{MOT SLOW}}$ signal goes high, thereby causing the $\overline{\text{MOT RUN}}$ signal to go low.

FIG. 8 is a schematic of the knife solenoid driver circuitry, which includes optoisolator 312, transistors Q15-Q17, resistors R57-R61, zener diodes CR3 and CR4, diode CR5, and light emitting diode LED5.

Optoisolator 312 receives the CT signal from circuitry of FIG. 6. The CT signal is normally low and has a high pulse (1) at the end of a film feed and cut cycle or (2) when the trim switch 80 has been depressed. Transistor Q17 is turned on when the CT signal is high. The KNIFE SOL signal is derived from the collector of transistor Q17 and is supplied to the knife solenoid.

A protective circuit formed by resistor R57, zener diode CR3 and transistor Q15 is provided to prevent erroneous operation of the film cutting knife. The protective circuit prevents the knife solenoid from being energized when power to the semi-automatic film cutter is either being turned on or off.

Summary of Operation

The semiautomatic film cutter has two modes of operation. The first mode is the normal film feed and cut cycle. The second mode of operation is the film feed controlled by either film forward switch 76 or film reverse switch 78. The following is a summary of the operation of the semiautomatic film cutter.

In the first operating mode, movable cursor 50 is moved to calibration position 66. Calibrate switch 74 is then depressed, thereby causing the $\overline{\text{INITIALIZE}}$ signal in FIG. 5 to go low. This causes the reference or initial count to be entered into counters 106, 108, and 110. Movement of the movable cursor from the calibrate position causes either count up or count down pulses to be provided to counters 106, 108, and 110.

When the operator depresses either start button 82 or the foot switch (not shown) the $\overline{\text{START}}$ signal goes low. This causes the count then contained in counters 106, 108, and 110 to be transferred to counters 148, 150, and 152.

The load pulse from NAND gate 146 is also the SS signal, which is supplied to the circuit shown in FIG. 6. This sets the Motor Run flipflop 164 and the Motor Fast flipflop 166. When flipflops 164 and 166 are high, both the MOT FAST and MOT RUN signals are high, thereby causing the oscillator 248 in FIG. 7 to begin operation. The frequency of the OSC signal produced by the oscillator 148 increases from the idle speed of 500 Hz to the fast speed of about 2000 Hz.

Counters 148, 150 and 152 count down in response to OSC signal from oscillator circuit 248. When counters 148, 150 and 152 reach zero, the CC signal goes low. This causes Motor Fast Flipflop 166 to be reset and the MOT FAST signal to go low, which in turn causes the frequency of oscillator 248 to decrease from the 2000 Hz fast speed to the 500 Hz idle speed. In addition, when Motor Fast flipflop 166 is reset, it causes the reset to be removed from ramp down and stop adjust counter 180 and flipflop 188 to be removed. Ramp down and stop adjust counter 180 determines the number of steps that the stepper motor takes after the CC signal has been produced. During these steps, the frequency of the OSC signal, and therefore the frequency of the steps, is decreasing so that the film is gradually brought to a stop.

When the desired number of additional steps have been taken, flipflop 198 receives a high set signal and the $\overline{Q}$ output of flipflop 198 goes low. This causes Motor Run flipflop 164 to be reset and the MOT RUN signal to go low. When the MOT RUN signal goes low, oscillator 248 of FIG. 7 is stopped.

When the $\overline{Q}$ output of flipflop 198 goes low, thereby causing Motor Run flipflop 164 to be reset, it also causes the CT pulse signal to be produced. A CT pulse signal may also be produced independent of a film feed and cut cycle by depressing trim switch 80, which causes the $\overline{\text{TRIM SW}}$ signal to go low. In either case, the CT signal is received by the knife solenoid drive circuit shown in FIG. 8 and the KNIFE SOL pulse is produced. The KNIFE SOL signal causes the film cutter knife to operate.

The stepper motor driver circuitry shown in FIG. 7 produces the $\phi$AR, $\overline{\phi\text{AR}}$, $\phi$BR, and $\overline{\phi\text{BR}}$ signals which are supplied to the stepper motor. The direction of stepper motor drive depends upon the phase relationship of the $\phi$AR and $\phi$BR signals. The frequency of the steps of the stepper motor is determined by oscillator 248. The power required to supply the $\phi$AR, $\overline{\phi\text{AR}}$, $\phi$BR, and $\overline{\phi\text{BR}}$ signals to the stepper motor is controlled by the circuit including NOR gate 238, inverter buffers 240 and 242, stepper power shutdown 244, optoisolator 246, resistors R36-R41, capacitors C3 and C4, diode CR1 and transistors Q11-Q13. When both the MOT RUN and MOT RUN2 signals go low, transistors Q12 and Q13 are turned off after a time delay determined by stepper motor power shutdown timer 244. Power to the stepper motor, therefore, is turned off shortly after the knife solenoid has been energized.

The second mode of operation is controlled by film forward switch 76 and film reverse switch 78. If either switch 76 or 78 is depressed, the $\overline{\text{MOT SLOW SW}}$ signal goes low, which causes the motor slow debounce circuit formed by counter 158 and NOR gate 160 of FIG. 5 to produce the $\overline{\text{MOT SLOW}}$ signal. The $\overline{\text{MOT SLOW}}$ signal is low when the $\overline{\text{MOT SLOW SW}}$ signal is low. If the motor reverse switch 78 is the switch which is depressed, $\overline{\text{MOT REV SW}}$ signal also is low when the $\overline{\text{MOT SLOW SW}}$ singal goes low. The motor reverse debounce circuit formed by counter 154 and NOR gate 156 of FIG. 5 produces the $\overline{\text{MOT REV}}$ signal which goes low when the reverse switch 78 is depressed.

The $\overline{\text{MOT SLOW}}$ signal is NORed with the output of Motor Run flipflop 164 by NOR gate 170 of FIG. 6. The output of NOR gate 170 is the MOT RUN signal. When the $\overline{\text{MOT SLOW}}$ signal goes low, the MOT RUN signal goes high.

When the MOT SLOW signal goes low and the MOT RUN signal goes high, oscillator 248 in FIG. 7 begins to produce the OSC signal. The frequency of the OSC signal in the second mode of operation is controlled by the state of transistor Q14. When the $\overline{\text{MOT SLOW}}$ signal goes low initially, it turns off transistor Q16, thereby causing the frequency of the OSC signal to be determined by resistors R54 and R55. In the preferred embodiments, resistors R54 and R55 have been selected so that the frequency of the OSC signal is 25 Hz.

The single step circuit including counter 292, flipflops 268 and 294, inverter 296, and NOR gates 298 and 300 allow the flipflop 270 and 272, produce only a single step signal to the stepper motor. If the $\overline{\text{MOT SLOW}}$ signal remains low for the time required for counter 292 to count to eight, then the output of flipflop 268 goes high and flipflops 270 and 272 are allowed to produce further step pulses.

After counter 292 has counted to eight, the stepper driver cricuitry generates up to 64 step pulses at a rate of 25Hz. If the $\overline{\text{MOT SLOW}}$ signal goes high at any time during the 64 steps, no further pulses are produced. If, on the other hand, the $\overline{\text{MOT SLOW}}$ signal remains low, the counters 302 and 304 will count to 64 and transistor Q16 will then be turned on. This enables the idle speed control resistors R51 and R52 to control the frequency of the OSC signal produced by oscillator 248. When Q16 turns on, the frequency of the OSC signal increases from 25 Hz to 500 Hz. The stepper driver circuitry continues to produce step pulses at the 500 Hz rate so long as the $\overline{\text{MOT SLOW}}$ signal remains low. When the $\overline{\text{MOT SLOW}}$ signal goes high, the production of step pulses is terminated and the film speed stops.

The direction of film feed in the second mode of operation is determined by the state of the $\overline{\text{MOT REV}}$ signal. The direction of rotation of the stepper motor drive is determined by the output of NOR 282, which supplies inputs to exclusive NOR gates 278 and 280. The output of NOR gate 282 is controlled by the state of the $\overline{\text{MOT REV}}$ signal by means of inverter 284, NAND gate 286, and flipflops 288 and 290.

Conclusion

The present invention is a highly advantageous web drive system for use in photographic systems. Although the invention has been described with reference to preferred embodiments, workers skilled in the art will recognize that changes may be made in form and detail without departing from the spirit and scope of the invention. For example, although the present invention has been described in the context of a semiautomatic film cutter, other photographic systems such as automatic and manual film cutters, semiautomatic film notchers, and paper cutter may also use the invention to advantage.

What is claimed is:

1. In a photographic system, a web drive system comprising:

switch means having first and second states, the switch means normally having the first state and having the second state only while being operator actuated, the switch means returning to the first state when opertor actuation is removed; and web drive means for driving the web a predetermined distance at a first rate during a first period in response to the switch means being switched from the first to the second state, discontinuing driving the web after the predetermined distance if operator actuation is removed during the first period causing the switch means to return to the first state, and driving the web at a second rate after the first period if operator actuation continues uninterrupted throughout the first period and thereafter so that the switch means remains in the second state continuously throughout the first period and thereafter.

2. The invention of claim 1 wherein the web drive means drives the web at the second rate until operator actuation is removed causing the switch means to switch from the second to the first state or until the end of a second period, whichever occurs first.

3. The invention of claim 2 wherein the web drive means drives the web at a third rate, higher than the second rate, if operator actuation continues uninterrupted so that the switch means remains in the second state after the end of the second period.

4. The invention of claim 1 wherein the web drive means comprises step drive means for driving the web in steps.

5. The invention of claim 4 wherein the step drive means drives the web a predetermined number of steps during the first period.

6. The invention of claim 5 wherein the predetermined number is one.

7. In a photographic system, a web drive system comprising:

switch means having first and second states; and web drive means for driving the web a predetermined distance at a first rate during a first period in response to the switch means being switched from the first to the second state, and driving the web at a second rate if the switch means remains in the second state after the first period, the web drive means comprising:

stepper motor means for driving the web in steps;

oscillator means for providing an oscillator signal; and stepper motor control means for limiting the stepper motor means to a predetermined number of steps during the first period and permitting the stepper motor means to step at a rate determined by the frequency of the oscillator signal if the switch means remains in the second state after the first period.

8. The invention of claim 7 wherein the step drive means further comprises:

oscillator frequency control means for causing the frequency of the oscillator signal to increase from a lower to a higher frequency if the switch means remains in the second state after a second period.

9. The invention of claim 8 wherein the stepper motor control means comprises:

step signal means for providing step signals to the stepper motor means in response to the oscillator signal;

first counter means for counting, in response to the oscillator signal, to a first predetermined count, the time required to count to the first predetermined count determining the first period; and step limiting means for limiting the step signals provided to the predetermined number until the first counter means reaches the first predetermined count.

10. The invention of claim 9 wherein the oscillator frequency control means comprises:

second counter means for counting, in response to the oscillator signal, to a second predetermined count, the time required to count to the second predetermined count determining the second period; and frequency increasing means for increasing the frequency of the oscillator signal when the second counter means reaches the second predetermined count.

11. The invention of claim 10 wherein the oscillator means starts producing the oscillator signal in response to the switch means switching from the first to the second state and stops producing the oscillator signal in response to the switch means switching from the second state to the first state.

12. The invention of claim 11 and further comprising means for disabling the first and second counters when the switching means is in the first state.

13. The invention of claim 1 wherein the switch means comprises:

forward switch means having the first and second states;

reverse switch means having the first and second states; and web direction control means for causing the web drive means to drive the web in a forward direction if the forward switch means is in the second state and causing the web drive means to drive the web in a reverse direction if the reverse switch means is in the second state.

14. A web drive system for driving a web of photographic material, the web drive system comprising:

switch means;

stepper motor means for driving the web in steps;

oscillator means for providing an oscillator signal; and stepper motor control means for limiting the stepper motor means to a predetermined number of steps during a first period following actuation of the switch means and permitting the stepper motor means to step at a rate determined by the frequency of the oscillator signal if the switch means remains actuated after the first period.

15. The invention of claim 14 wherein the stepper motor control means comprises:

step signal means for providing step signals to the stepper motor means in response to the oscillator signal;

first counter means for counting, in response to the oscillator signal, to a first predetermined count, the time required to count to the first predetermined count determining the first period; and step limiting means for limiting the step signals provided to the predetermined number until the first counter means reaches the first predetermined count.

16. The invention of claim 14 and further comprising:

oscillator frequency control means for causing the frequency of the oscillator signal to increase from a lower to a higher frequency if the switch means remains actuated after a second period.

17. The invention of claim 16 wherein the oscillator frequency control means comprises:

second counter means for counting, in response to the oscillator signal, to a second predetermined count, the time required to count to the second predetermined count determining the second period; and frequency increasing means for increasing the frequency of the oscillator signal when the second counter means reaches the second predetermined count.

18. The invention of claim 14 wherein the switch means may be actuated and de-actuated, and wherein the oscillator means starts providing the oscillator signal in response to actuation of the switch means and stops providing the oscillator signal in response to de-actuation of the switch means.

19. The invention of claim 14 wherein the switch means comprises:

forward switch means;

reverse switch means; and web direction control means for causing the stepper motor means to drive the web in a forward direction if the forward switch means is actuated and causing the stepper motor means to drive the web in a reverse direction if the reverse switch means is actuated.

* * * * *